US009697965B2

(12) United States Patent
Chen

(10) Patent No.: US 9,697,965 B2
(45) Date of Patent: Jul. 4, 2017

(54) KEY STRUCTURE WITH REDUCED RESONANT NOISE

(71) Applicant: LITE-ON TECHNOLOGY CORPORATION, Taipei (TW)

(72) Inventor: Chun-Lin Chen, New Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 23 days.

(21) Appl. No.: 14/842,935

(22) Filed: Sep. 2, 2015

(65) Prior Publication Data

US 2016/0148763 A1 May 26, 2016

(30) Foreign Application Priority Data

Nov. 24, 2014 (TW) ..... 103140625 A

(51) Int. Cl.
*H01H 13/705* (2006.01)
*H01H 13/704* (2006.01)
*H01H 3/12* (2006.01)

(52) U.S. Cl.
CPC ..... *H01H 13/705* (2013.01); *H01H 13/704* (2013.01); *H01H 3/125* (2013.01); *H01H 2209/024* (2013.01); *H01H 2221/062* (2013.01)

(58) Field of Classification Search
CPC ..... H01H 13/14; H01H 13/52; H01H 13/02
USPC ..... 200/5 A, 341, 310, 344
See application file for complete search history.

(56) References Cited

U.S. PATENT DOCUMENTS 6,160,233 A * 12/2000 Hu ..... H01H 3/125 200/341
2004/0074753 A1† 4/2004 Chen
2012/0048698 A1* 3/2012 Yen ..... H01H 3/122 200/344
2013/0228433 A1* 9/2013 Shaw ..... G06F 1/1618 200/5 A

* cited by examiner
† cited by third party

*Primary Examiner* — Edwin A. Leon
*Assistant Examiner* — Iman Malakooti
(74) *Attorney, Agent, or Firm* — Li & Cai Intellectual Property (USA) Office

(57) ABSTRACT

A key structure with reduced resonant noise includes a base plate formed with a first supporting portion and a second supporting portion, a conductive film layer, an elastic conducting element, a linking rod, and a keycap on the linking rod. The linking rod has a main portion, a first arm extended from one end of the main portion and pivotally connected to the first supporting portion, and a second arm extended from the other end of the main portion and pivotally connected to the second supporting portion. The key cap has a bottom surface pivotally connected to the main portion of the linking rod. The base plate has openings under the linking rod and adjacent to the first supporting portion and the second supporting portion. The openings can reduce resonant effect of clapping sound in the keycap, when the keycap is pressed.

12 Claims, 5 Drawing Sheets

KEY STRUCTURE WITH REDUCED RESONANT NOISE

BACKGROUND OF THE INVENTION

1. Field of the Invention

The present invention is related to a key structure with reduced resonant noise. In particular, the present invention relates to a key structure that has less noise during operation.

2. Description of Related Art

The manufacturing technology of the keyboard has continuously developed toward the goal of thinning the height. All elements of the keyboard therefore are closer and closer. However, providing enough pressing stroke (traveling distance) for the keycap is also required. The distance used to reduce noise has been sacrificed in the structural design, and the keycap is pressed directly to hit the conductive film and the base plate under the conductive film.

According to a test of a conventional keyboard of a notebook, a position being 26 cm high above the keyboard has a noise about 60 db when hitting a keycap. Based on the human factors standard, such a value for noise is enough to become an interference for anyone nearby.

To explore the source of shrill noise when hitting the keyboard, one crucial reason is the metal plate in the keyboard which causes a high-frequency noise when being hit. Besides, after the keycap is pressed down, there is an almost sealed space formed between the keycap and the conductive film above the base plate, which is like a small resonance chamber, so as to provide a resonant effect and amplify the noise.

Therefore, it is desirable to propose a novel key structure to overcome the above-mentioned problems.

SUMMARY OF THE INVENTION

The present disclosure provides a key structure with reduced resonant noise, which reduces noise during operating the key structure by decreasing the resonant effect of the sound in a keycap when hitting the keycap.

In order to achieve the above objectives, an embodiment according to the present disclosure is to provide a key structure with reduced resonant noise, which includes a base plate, a conductive film layer, an elastic conducting element, a linking rod, and a keycap. The base plate is formed with a first supporting portion and a second supporting portion. The conductive film layer is disposed on the base plate. The elastic conducting element is disposed on the conductive film layer. The linking rod is arranged above the base plate. The linking rod has a main portion, a first arm connected to one end of the main portion and a second arm connected to another end of the main portion. The first arm is pivotally connected to the first supporting portion. The second arm is pivotally connected to the second supporting portion. The keycap is arranged above the linking rod. A bottom surface of the keycap is pivotally connected to the main portion of the linking rod. The base plate has a plurality of openings formed on a position thereof under the linking rod and on positions thereof approximated to the first supporting portion and the second supporting portion. The openings are respectively approximated to two ends of the main portion, the first arm and the second arm, so that the openings can decrease the resonant effect of the clap sound in a keycap when hitting the keycap.

In order to achieve the above objectives, another embodiment according to the present disclosure is to provide a key structure with reduced resonant noise, which includes a base plate, a conductive film layer, an elastic conducting element, a linking rod, and a keycap. The base plate is formed with a first supporting portion and a second supporting portion. The conductive film layer is disposed on the base plate. The elastic conducting element is disposed on the conductive film layer. The linking rod is arranged above the base plate. The linking rod has a main portion, a first arm and a second arm. The first arm is pivotally connected to the first supporting portion. The second arm is pivotally connected to the second supporting portion. The keycap is arranged above the linking rod. A bottom surface of the keycap is pivotally connected to the main portion of the linking rod. The base plate has a plurality of openings on a position thereof under the linking rod and on positions thereof approximated to the first supporting portion and the second supporting portion. The openings are respectively approximated to an underneath of the main portion and a middle of the main portion, so that the openings can decrease the resonant effect of the clap sound in a keycap when hitting the keycap.

Thus, the present disclosure has advantages as follows. This present disclosure can decrease the resonant effect by a chamber between the keycap and the base plate acting like a sound resonator. The noise when the keyboard is hitting can be reduced effectively by decreasing the resonant noise.

For further understanding of the present disclosure, reference is made to the following detailed description illustrating the embodiments and examples of the present disclosure. The description is for illustrative purpose only and is not intended to limit the scope of the claim.

DETAILED DESCRIPTION OF THE PREFERRED EMBODIMENTS

[First Embodiment]

Figure 1:
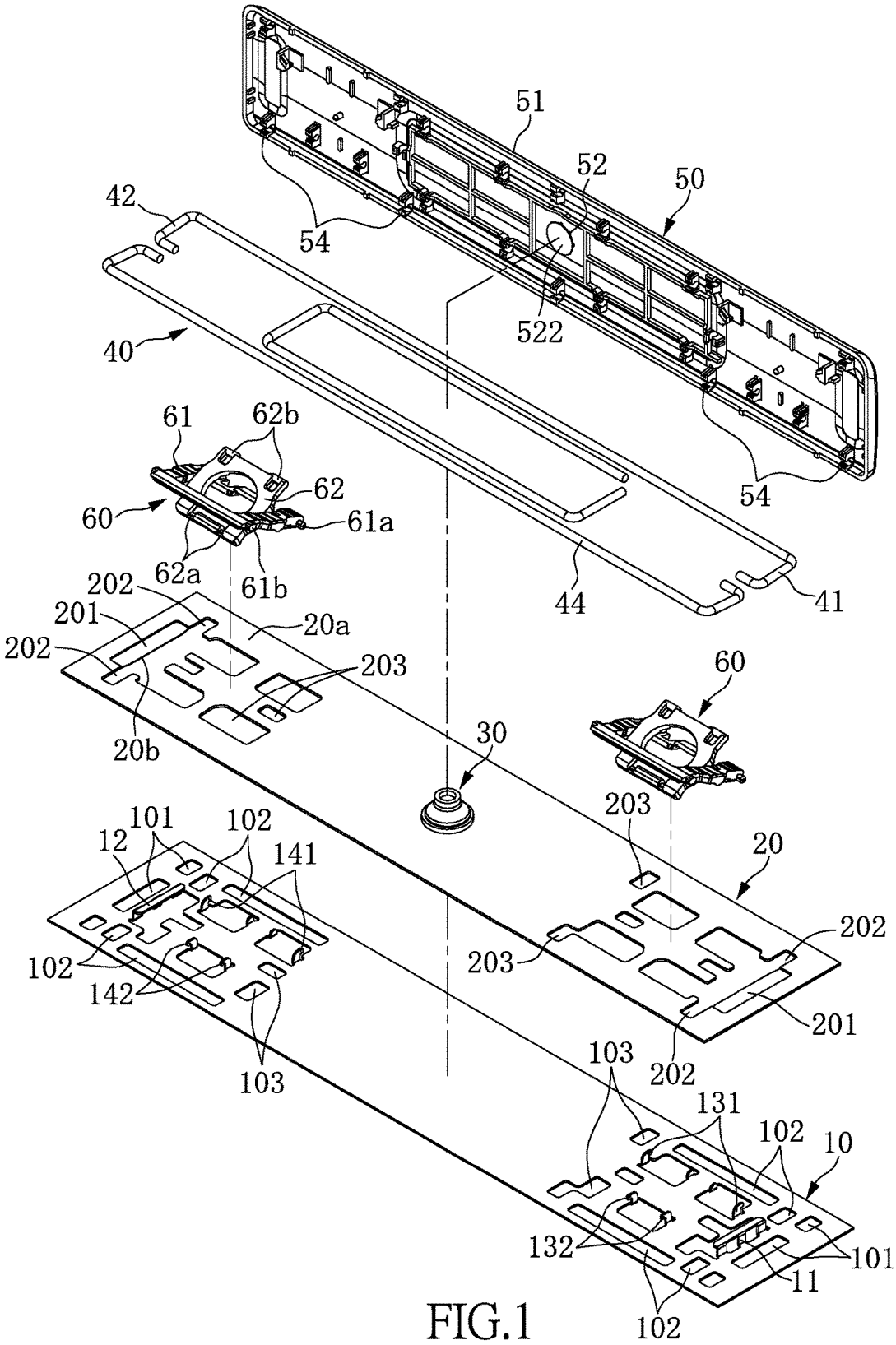
FIG. 1 is an exploded perspective view of key structure with reduced resonant noise according to the present disclosure.

Please refer to FIG. 1, which is an exploded perspective view of key structure with reduced resonant noise according to the present disclosure. This embodiment provides a key structure with reduced resonant noise, and is illustrated by an example of multiple keys as shown in FIG. 1, such as a space key, Shift key, Enter key . . . etc. The key structure includes a base plate 10, a conductive film layer 20 disposed on the base plate 10, an elastic conducting element 30 disposed on the conductive film layer 20, a linking rod 40 arranged above the base plate 10, and a keycap 50 arranged above the linking rod 40.

The base plate 10 is formed with a first supporting portion 11 and a second supporting portion 12. The linking rod 40 has a main portion 44, a first arm 41 connected to one end of the main portion 44, and a second arm 42 connected to the other end of the main portion 44. The first arm 41 is pivotally connected to the first supporting portion 11, and the second arm 42 is pivotally connected to the second supporting portion 12. A bottom surface of the keycap 50 is formed with a plurality of buckling portions 54 for pivotally connecting to the main portion 44 of the linking rod 40.

The base plate 10 further has a plurality of pivotal portions 131, 132, 141, 142 for pivotally connecting to a rising-lowering module 60. The rising-lowering module 60 includes a first component 61 and a second component 62. The first component 61 and the second component 62 respectively have lower pivotal portions 61*a*, 62*a* pivotally connected to the pivotal portions 131, 132, 141, 142 of the base plate 10 and upper pivotal portions 61*b*, 62*b* pivotally connected to a bottom surface of the keycap 50.

In this embodiment, the base plate 10 has openings 101, 102, 103 formed on a position under the linking rod 40 and approximated to the first supporting portion 11 and the second supporting portion 12. The openings 101, 102, 103 are approximated to two ends of the main portion 44, the first arm 41 and the second arm 42. Thus, the openings 101, 102, 103 can decrease the resonant effect of the clap sound in keycap 50 when the keycap 50 is pressed or clicked.

The arrangement of the openings 101, 102, 103 of this embodiment is described in detail as follows. The positions of the openings 101, 102, 103 correspond substantially to an underneath of the hitting positions F on the keycap 50 by a user's fingers, such as shown FIG. 2, and approximated to an underneath of a side wall 51 of the keycap 50 as shown in FIG. 2B, which is a cross-sectional view along line B-B of FIG. 2 according to the present disclosure. The openings 101 and 103 are distributed at left and right sides of the hitting position F. The opening 102 is distributed at front and rear sides of the hitting position F. As shown in FIG. 2B, the opening 102 is substantially corresponding to a bottom of the side wall 51 of the keycap 50, and approximated to an underneath of the linking rod 40.

According to the right part of FIG. 1, the openings 101, 102, 103 are arranged substantially around the first supporting portion 11, the pivotal portions 131, 132 in a ring shape. With regard to a space key, the space key is usually hit on the middle and two sides. The conductive film layer 30 is arranged under the middle of the space key, which can provide the effect of absorbing some shock. Two sides of the space key produce the most clap noise when the keycap is hit. The openings 101, 102, 103 in this embodiment thus are arranged substantially corresponding to an underneath of the hitting position F and approximated to an underneath position adjacent to the side wall 51 of the keycap 50. Therefore, the clap sounds can be propagated outward through the openings 101, 102, 103. When the keycap 50 is pressed, the resonant effect of the clap sound is decreased.

In this embodiment, the conductive film layer 20 could be composed of three films. The top film 20*a* has a positive electrode, the bottom film has a negative electrode, and the middle film is a nonconductive plastic sheet. The conductive film layer can be one available conventionally, and is not described redundantly. The conductive film layer 20 is formed with a plurality of through holes 201, 202, 203 corresponding to the openings 101, 102, 103. This corresponding relationship means that positions are matched and some are not completely matched to each other, because the conductive film layer 20 has conductive circuits and the positions of the through holes are limited. Otherwise, the conductive film layer 20 is flexible and can absorb some impacting energy when the conductive film layer 20 is clapped by the keycap 50 or the linking rod 40.

Figure 2:
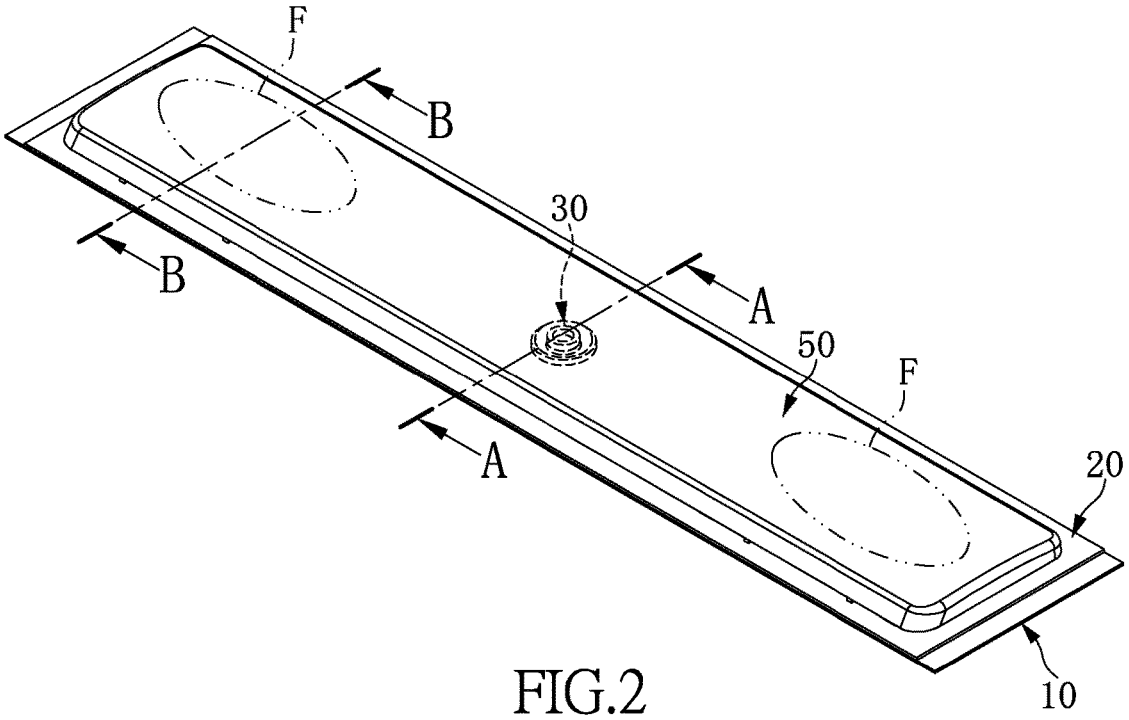
FIG. 2 is assembled perspective view of key structure with reduced resonant noise according to the present disclosure.
Figure 2A:
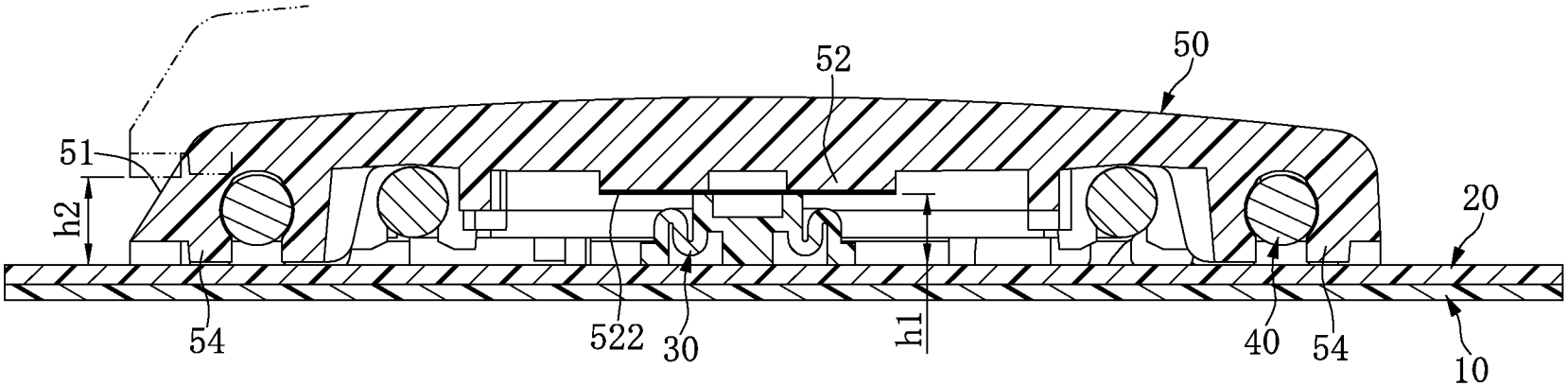
FIG. 2A is a cross-sectional view along line A-A of FIG. 2 according to the present disclosure.
Figure 2B:
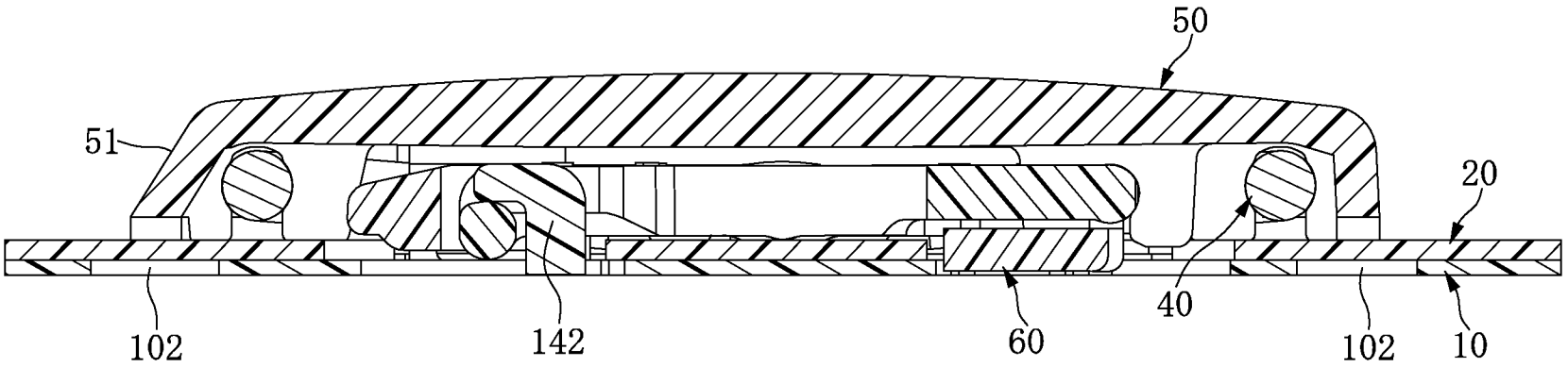
FIG. 2B is a cross-sectional view along line B-B of FIG. 2 according to the present disclosure.

Please refer to FIG. 2A, which is a cross-sectional view along line A-A of FIG. 2. The bottom surface of the keycap 50 has a protruded seat 52 corresponding to the top end of the elastic conducting element 30. With regard to conventional art, the protruded seat is directly against the elastic conducting element. In this embodiment, in order to reduce noise aimed to the middle of the key cap, a pad 522 can be further disposed on the bottom surface of the protruded seat 52 and contacted with a top end of the elastic conducting element 30. The pad 522 has a height preferable of 0.05 to 0.1 mm. Because the key structure is developing toward a thinning tendency currently, the keycap stroke (traveling distance) is almost directly pressed to impact the conductive film layer 20 and the base plate 10. In this embodiment, when a pressing stroke h2 of the keycap 50 is downward pressed to end, it is simultaneously pressed to the end. The elastic conducting element 30 will be pressed down a little more distance by the pad 522. Compared with the condition without an additional pad, the height h1 of the elastic conducting element 30 of this embodiment will be lower, and the elastic conducting element 30 can provide a shock-absorbing effect. Therefore, this embodiment can additionally press downward the elastic conducting element 30 by the pad 522, so as to provide a shock-absorbing effect and reduce the clap sound when pressing the keycap 50.

[Second Embodiment]

Figure 3:
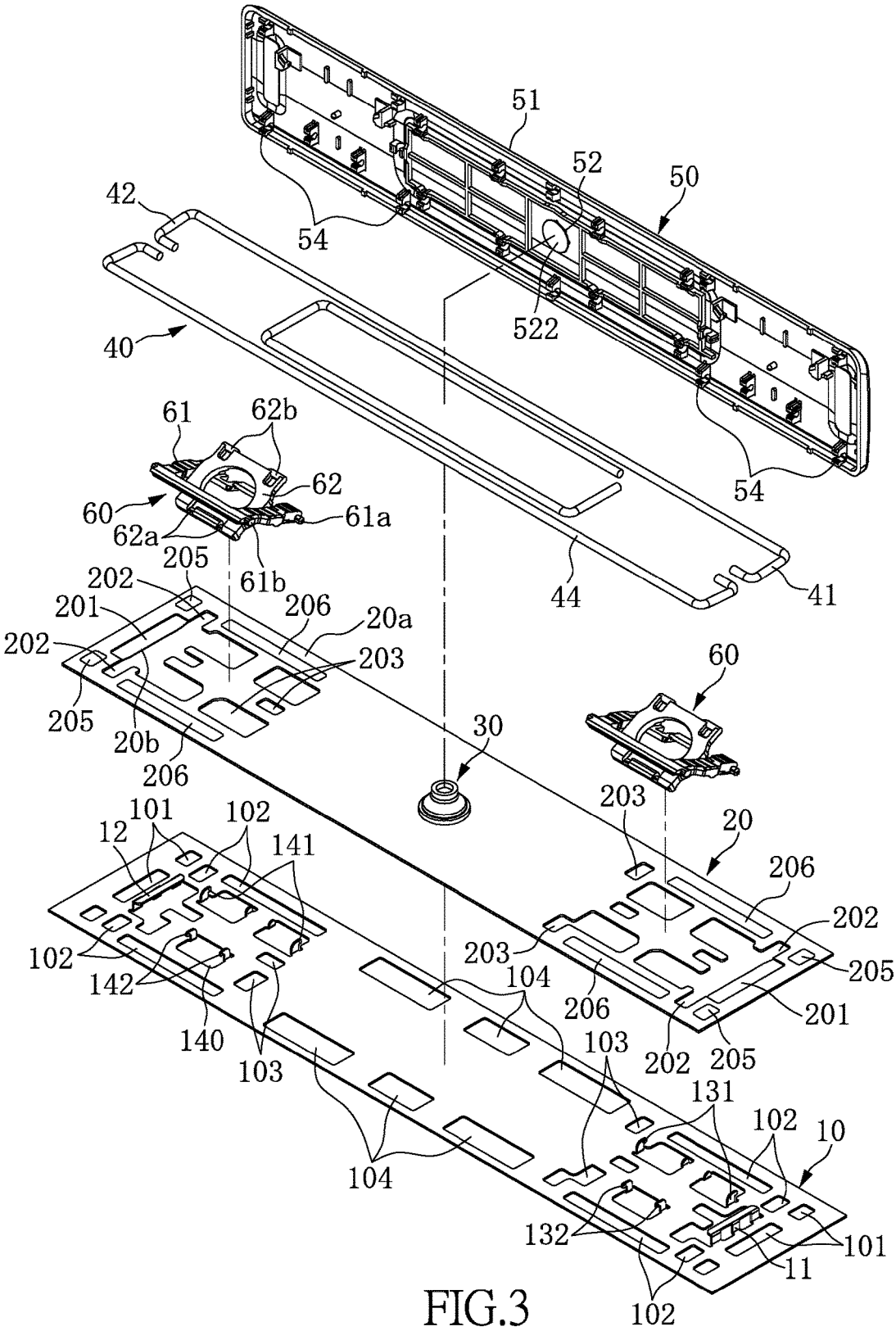
FIG. 3 is an exploded perspective view of key structure with reduced resonant noise according to another embodiment of the present disclosure.

Please refer to FIG. 3. The difference between this embodiment and the above embodiment is the positions of the openings. The key structure has openings 101, 102, 103, 104 formed on the base plate 10, which are arranged along the underneath of the linking rod 40 and approximated to the first supporting portion 11 and the second supporting portion 12. In this embodiment, besides the openings 101, 102, 103 which are matching with two ends of the main portion 44 of the linking rod 40 and approximated to the first arm 41 and the second arm 42, the openings 104 are further formed under the main portion 44 of the linking rod 40 and approximated to the middle of the main portion 44. The openings 104 can further decrease the resonant effect of clap sound in the keycap 50 when pressing the keycap 50. This embodiment can reduce more clap sound when the middle of the keycap 50 is pressing down.

Furthermore, the conductive film layer 20 of this embodiment has a plurality of flexible layers 205, 206 corresponding to corners of the keycap 50, so that the striking force of the side wall 51 of the keycap 50 can be absorbed directly to reduce noise sound.

In order to reduce the noise produced when pressing keycaps, the present disclosure decreases the resonant effect similar to resonance chamber between the keycap 50 and the base plate 10. By reducing the resonant sound, it can reduce the noise when the keypads are striking. Besides, the present disclosure also provides other arrangements for reducing noise. The pad 522 is attached to the bottom surface of the keycap 50, and the elastic conducting element 30 can be pressed slightly extra to provide a shock-absorbing effect. The downward clicking force of the side wall 51 of the keycap 50 can be decreased. Furthermore, in the second embodiment, there are more openings 104 formed corresponding to the middle of the keycap 50. The openings 101-104 substantially surround the bottom edges of the keycap 50 and are arranged in a rectangle shape, so that it can suppress the resonant effect more to reduce the noise.

The above-mentioned descriptions represent merely the preferred embodiment of the present invention, without any intention to limit the scope of the present invention thereto. Various equivalent changes, alterations or modifications based on the claims of present invention are all consequently viewed as being embraced by the scope of the present invention.

What is claimed is:

1. A key structure with reduced resonant noise, comprising:

a base plate, formed with a first supporting portion and a second supporting portion;

a conductive film layer, disposed on the base plate;

an elastic conducting element, disposed on the conductive film layer;

a linking rod, arranged above the base plate, the linking rod having a main portion, a first arm connected to one end of the main portion and a second arm connected to the other end of the main portion, a bottom end of the first arm pivotally connected to the first supporting portion, a bottom end of the second arm pivotally connected to the second supporting portion; and a keycap, arranged above the linking rod, a bottom of the keycap pivotally connected to the main portion of the linking rod, the keycap having two short side walls respectively approximated to the first and second arms, and two long side walls parallel the main portion of the linking rod;

wherein the base plate has a plurality of first openings and second openings, the first openings arranged underneath the short side walls of the keycap and on an outer side of the first and second supporting portions, the second openings arranged parallel to and underneath the long side walls of the keycap, thereby the first and second openings decrease a resonant effect of clapping sounds in the keycap when the keycap are pressed against the conductive film layer.

2. The key structure with reduced resonant noise as claimed in claim 1, wherein the keycap is a multiple key, wherein the base plate has a plurality of third openings, positions of the third openings are arranged between the long side walls of the keycap.

3. The key structure with reduced resonant noise as claimed in claim 1, wherein the conductive film layer is formed with a plurality of first through holes substantially corresponding to the first openings of the base plate, wherein the first through holes pass through a top film of the conductive film layer.

4. The key structure with reduced resonant noise as claimed in claim 1, wherein the conductive film layer has at least one flexible layer disposed thereon underneath the long side wall of the keycap and underneath the second openings of the base plate.

5. The key structure with reduced resonant noise as claimed in claim 1, wherein the keycap has a protruded seat formed on a bottom surface thereof corresponding to a top end of the elastic conducting element, and a pad disposed on a bottom surface of the protruded seat against the top end of the elastic conducting element, wherein an area of the pad is larger than that of the top end of the elastic conducting element, the pad disposed between the top end of elastic conducting element and the protruded seat of the keycap.

6. The key structure with reduced resonant noise as claimed in claim 5, wherein the pad has a height of 0.05 to 0.1 mm.

7. A key structure with reduced resonant noise, comprising:

a base plate, formed with a first supporting portion and a second supporting portion;

a conductive film layer, disposed on the base plate;

an elastic conducting element, disposed on the conductive film layer;

a linking rod, arranged above the base plate, wherein the linking rod has a main portion, a first arm and a second arm, a bottom end of the first arm pivotally connected to the first supporting portion, a bottom end of the second arm pivotally connected to the second supporting portion; and a keycap, arranged on the linking rod, a bottom of the keycap pivotally connected to the main portion of the linking rod, the keycap having two short side walls respectively approximated to the first and second arms, and two long side walls parallel the main portion of the linking rod;

wherein the base plate has a plurality of openings, the openings arranged parallel to, underneath the long side walls of the keycap, and approximated to an underneath of the main portion and a middle of the main portion; thereby the openings decrease a resonant effect of clapping sounds in the keycaps produced by pressing the keycaps.

8. The key structure with reduced resonant noise as claimed in claim 7, wherein the openings are arranged to match two ends of the main portion and approximated to the first arm and the second arm.

9. The key structure with reduced resonant noise as claimed in claim 7, wherein the conductive film layer is formed with a plurality of through holes corresponding to the openings.

10. The key structure with reduced resonant noise as claimed in claim 7, wherein the conductive film layer has at least one flexible layer attached thereon corresponding to corners of the keycap.

11. The key structure with reduced resonant noise as claimed in claim 1, wherein the key structure has a pair of the linking rods arranged above the base plate, each of the linking rod having a main portion, a first arm connected to one end of the main portion and a second arm connected to the other end of the main portion, each bottom end of the first arms pivotally connected to the first supporting portion, each bottom end of the second arms pivotally connected to the second supporting portion.

12. The key structure with reduced resonant noise as claimed in claim 7, wherein the key structure has two rising-lowering modules connected on the base plate, and the openings are formed between the two rising-lowering modules.

* * * * *